US005867875A

United States Patent [19]

Beck et al.

[11] Patent Number: 5,867,875

[45] Date of Patent: Feb. 9, 1999

[54] FOLDABLE ZIPPER SLIDER WITH IMPROVED COMPRESSION-TYPE LATCH

[75] Inventors: Roland G. Beck, Auburn; Robert F. Brissette, Marcellus; Joachim Bocon, Webster; Gary F. Ebert, Walworth; Eric A. St. Phillips, Fairport, all of N.Y.

[73] Assignee: Tenneco Packaging Inc., Evanston, Ill.

[21] Appl. No.: 61,487

[22] Filed: Apr. 16, 1998

[51] Int. Cl.[6] ..... A44B 19/16

[52] U.S. Cl. ..... 24/400; 24/430; 24/416

[58] Field of Search ..... 24/399, 400, 416, 24/427, 430; 383/64

[56] References Cited

U.S. PATENT DOCUMENTS

| | | | |
|---|---|---|---|
| 3,942,713 | 3/1976 | Olson et al. | 229/62 |
| 3,990,627 | 11/1976 | Olson | 229/62 |
| 4,392,897 | 7/1983 | Herrington | 156/66 |
| 4,410,130 | 10/1983 | Herrington | 383/62 |
| 4,415,087 | 11/1983 | Clayton et al. | 206/632 |
| 4,419,159 | 12/1983 | Herrington | 156/66 |
| 4,519,095 | 5/1985 | Clayton | 383/86 |
| 4,561,109 | 12/1985 | Herrington | 383/65 |
| 4,603,434 | 7/1986 | Herrington | 383/95 |
| 4,618,383 | 10/1986 | Herrington | 156/66 |
| 4,787,754 | 11/1988 | Herrington | 383/63 |
| 5,007,142 | 4/1991 | Herrington | 24/400 |
| 5,007,143 | 4/1991 | Herrington | 24/400 |
| 5,010,627 | 4/1991 | Herrington et al. | 24/400 |
| 5,020,194 | 6/1991 | Herrington et al. | 24/400 |
| 5,063,644 | 11/1991 | Herrington et al. | 24/400 |
| 5,067,208 | 11/1991 | Herrington, Jr. et al. | 24/400 |
| 5,070,583 | 12/1991 | Herrington | 24/400 |
| 5,088,971 | 2/1992 | Herrington | 493/203 |
| 5,131,121 | 7/1992 | Herrington, Jr. et al. | 24/436 |
| 5,152,613 | 10/1992 | Herrington, Jr. | 383/63 |
| 5,161,286 | 11/1992 | Herrington, Jr. et al. | 24/387 |
| 5,189,764 | 3/1993 | Herrington et al. | 24/387 |
| 5,283,932 | 2/1994 | Richardson et al. | 24/400 |
| 5,301,394 | 4/1994 | Richardson et al. | 24/399 |
| 5,301,395 | 4/1994 | Richardson et al. | 24/400 |
| 5,405,478 | 4/1995 | Richardson et al. | 156/308.4 |
| 5,426,830 | 6/1995 | Richardson et al. | 24/430 |
| 5,431,760 | 7/1995 | Donovan | 156/66 |
| 5,442,837 | 8/1995 | Morgan | 24/400 |
| 5,442,838 | 8/1995 | Richardson et al. | 24/402 |
| 5,448,807 | 9/1995 | Herrington, Jr. | 24/399 |
| 5,448,808 | 9/1995 | Gross | 24/400 |
| 5,482,375 | 1/1996 | Richardson et al. | 383/64 |
| 5,669,715 | 9/1997 | Dobreski et al. | 383/5 |
| 5,682,730 | 11/1997 | Dobreski | 53/469 |
| 5,713,669 | 2/1998 | Thomas et al. | 383/204 |

FOREIGN PATENT DOCUMENTS

| | | |
|---|---|---|
| WO 91/13759 | 9/1991 | WIPO . |
| WO 95/35046 | 12/1995 | WIPO . |
| WO 95/35047 | 12/1995 | WIPO . |
| WO 95/35048 | 12/1995 | WIPO . |

*Primary Examiner*—James R. Brittain
*Attorney, Agent, or Firm*—Arnold White & Durkee

[57] ABSTRACT

A foldable plastic slider for straddling relation with a profiled plastic zipper. The straddling slider for closing or opening the zipper by movement therealong, comprising: a transverse support member including opposing sides, a pair of legs depending from the opposing sides of the support member, and a pair of wings hingedly attached to the opposing sides. Each wing has an opening for receiving its respective leg, and each wing has a cored out cross piece. The cored out cross piece has a solid ramp latch. The wings are folded relative to the support member and the latches engage the legs to assemble the slider on the zipper in a closed sidewall position.

20 Claims, 6 Drawing Sheets

FOLDABLE ZIPPER SLIDER WITH IMPROVED COMPRESSION-TYPE LATCH

FIELD OF THE INVENTION

The present invention generally relates to plastic sliders for opening and closing zippers of reclosable plastic bags and, more particularly, relates to a one-piece "gull wing" type foldable plastic slider having an improved compression-type latch for securely locking the slider in a folded position.

BACKGROUND OF THE INVENTION

Plastic zippers with sliders are well known in the art. The plastic zipper includes male and female tracks forming respective interlocking profiles. In the manufacture of a thermoplastic bag, the male and female tracks extend along the mouth of the bag and are adapted to be secured in any suitable manner to opposing flexible panels of the bag. The male and female tracks may be integral marginal portions of these flexible panels or they may be extruded separately and thereafter attached to the flexible panels along the mouth of the bag. The slider, which is mounted to the zipper, is used to open and close the zipper. When the slider is in a closed position, the profiles are interlocked with each other. In response to moving the slider to an open position, the profiles are disengaged from each other.

A foldable zipper slider with compression-type latch is disclosed in U.S. Pat. No. 5,063,644. This slider locks into place over the reclosable zipper using a flexible tongue compression-type latch. This flexible tongue style latch is effective on larger sliders, but when the size of the slider is reduced it becomes difficult and expensive to mold such an apparatus. Accordingly, there is a need to improve the compression-type latch so it can be effectively used on a smaller scale. The present invention seeks to achieve this result.

SUMMARY OF THE INVENTION

It is an object of the present invention to provide a new and improved one-piece foldable plastic zipper slider with compression-type latch.

The present invention relates to a foldable plastic slider for straddling relation with a profiled plastic zipper. The straddling slider for closing or opening the zipper by movement therealong comprises a transverse support member with opposing sides, a pair of depending legs, and a pair of wings hingedly attached to the opposing sides of the support member. The wings have openings for receiving the respective legs and each has a cored out cross piece. Each cored out cross piece has a solid sloped latch. The wings are folded relative to the support member and each solid sloped latch engages its respective leg. This locks the slider on the zipper.

BRIEF DESCRIPTION OF THE DRAWINGS

Other objects and advantages of the invention will become apparent upon reading the following detailed description and upon reference to the drawings in which.

Figure 1:
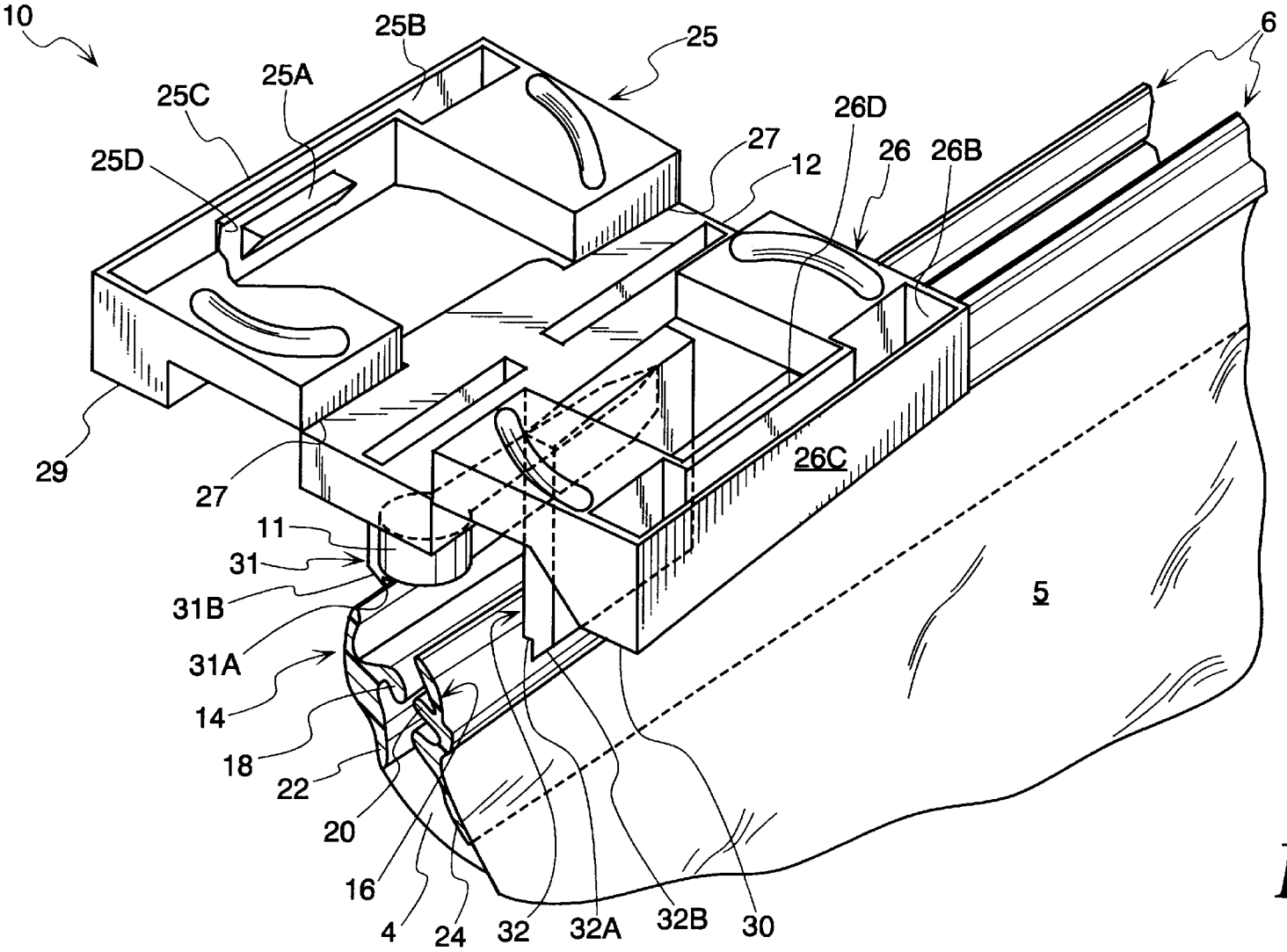
FIG. 1 is a perspective view of a foldable plastic slider embodying the present invention prior to being mounted on a zipper.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF PREFERRED EMBODIMENTS

Figure 3:
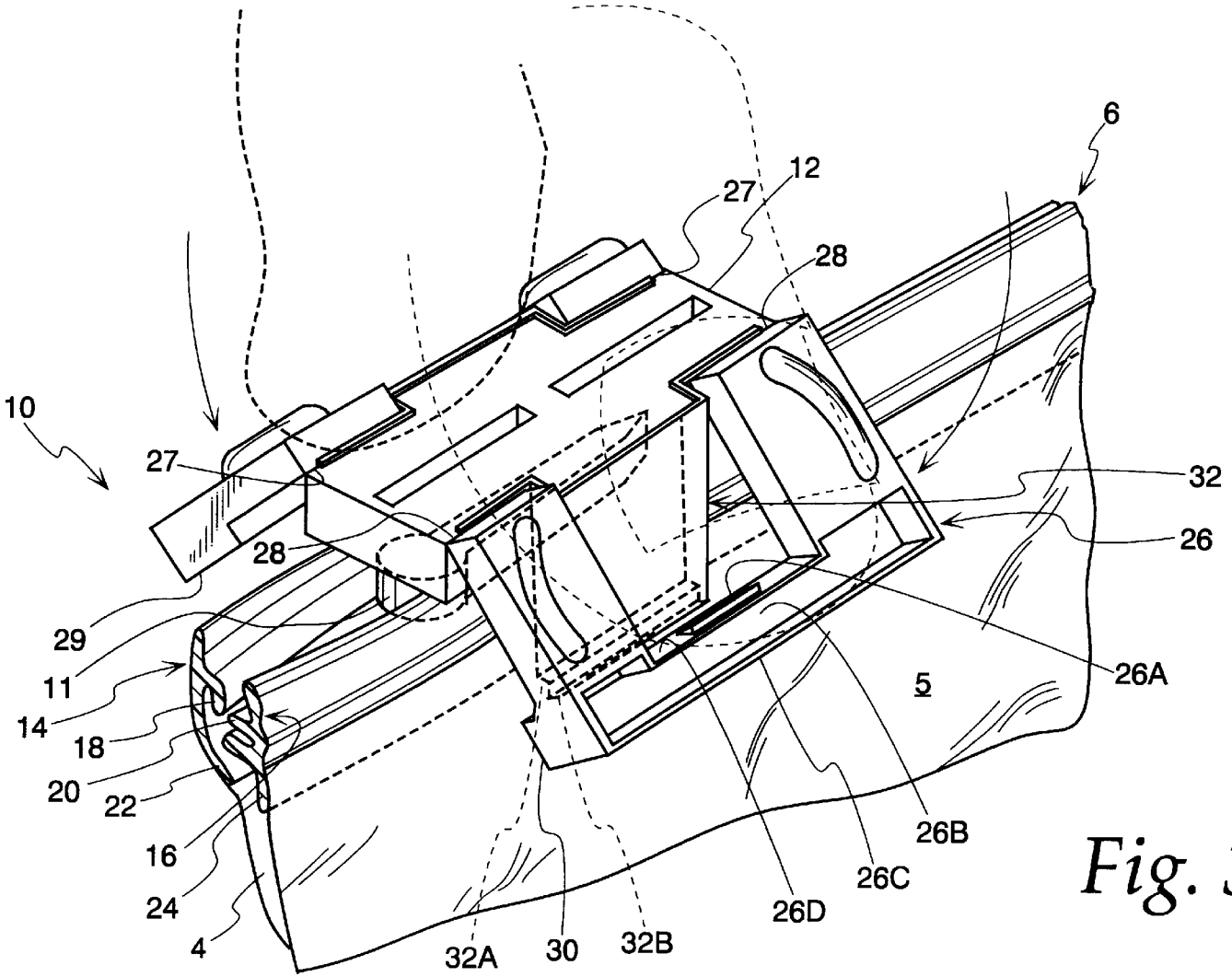
FIG. 3 is a perspective view of the foldable plastic slider in the process of being mounted on the zipper.
Figure 4:
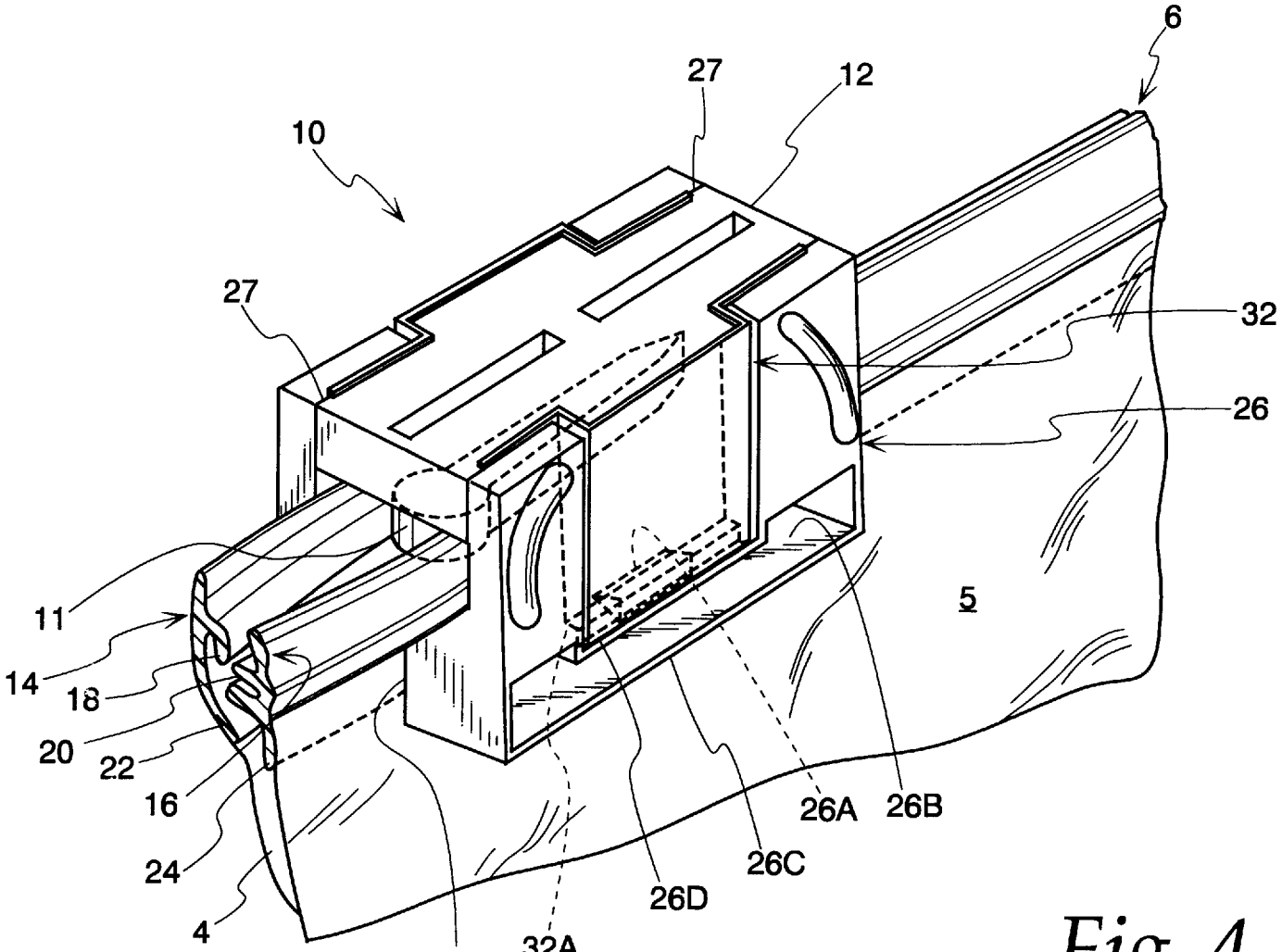
FIG. 4 is a perspective view of the foldable plastic slider after it has been mounted on the zipper.

FIGS. 1, 3 and 4 depict a mouth portion of a reclosable plastic bag embodying the present invention. The plastic bag comprises first and second opposing panels 4 and 5 fixedly connected to each other along a pair of sides (not shown) and a bottom (not shown) bridging the pair of sides. The bag is provided with a reclosable zipper 6 extending along the mouth portion, which is formed opposite the sealed bottom of the plastic bag.

The zipper 6 includes a male track 14 and a female track 16. The male track 14 includes a male profile 18 and a first depending fin or flange 22 extending downward from the male profile 18. Likewise, the female track 16 includes a female profile 20 and a second depending fin or flange 24 extending downward from the female profile 20. If the zipper 6 is formed separately from the panels 4 and 5 of the bag, the first and second fins 22 and 24 are thermally fused to inner surfaces of the respective first and second panels 4 and 5. Alternatively, the zipper 6 may be integrally formed with the panels 4 and 5 such that the first fin 22 is integrally formed with the first panel 4 and the second fin 24 is integrally formed with the second panel 5.

To assist in opening the plastic bag, a foldable plastic slider 10 is slidably mounted to the zipper 6 for movement between a closed position and an open position. FIG. 1 illustrates the slider 10 prior to being mounted on the zipper 6, while FIG. 4 illustrates the slider 10 after it has been mounted to the zipper 6. The slider 10 in its assembled position shown in FIG. 4 forces the male and female profiles 18 and 20 into engagement. The slider 10 has an opening end and a closing end, the slider 10 is wider at the opening end to allow separation of the male and female profiles 18 and 20. The slider is sufficiently narrow at the closing end to press the male and female profiles 18 and 20 into an interlocking relationship as the slider 10 is moved in the closing direction.

The slider 10 is formed from a single piece of molded plastic such as, for example, nylon, polypropylene, polystyrene, Delrin or ABS. The slider 10 is particularly suited for use with profiled plastic reclosable fasteners or zippers and thermoplastic bags. The examples of the bag and zipper, and construction of the slider and zipper are more fully described in U.S. Pat. Nos. 5,063,644, 5,067,208 and 5,007,143 which are incorporated herein by reference in their entirety.

Figure 2:
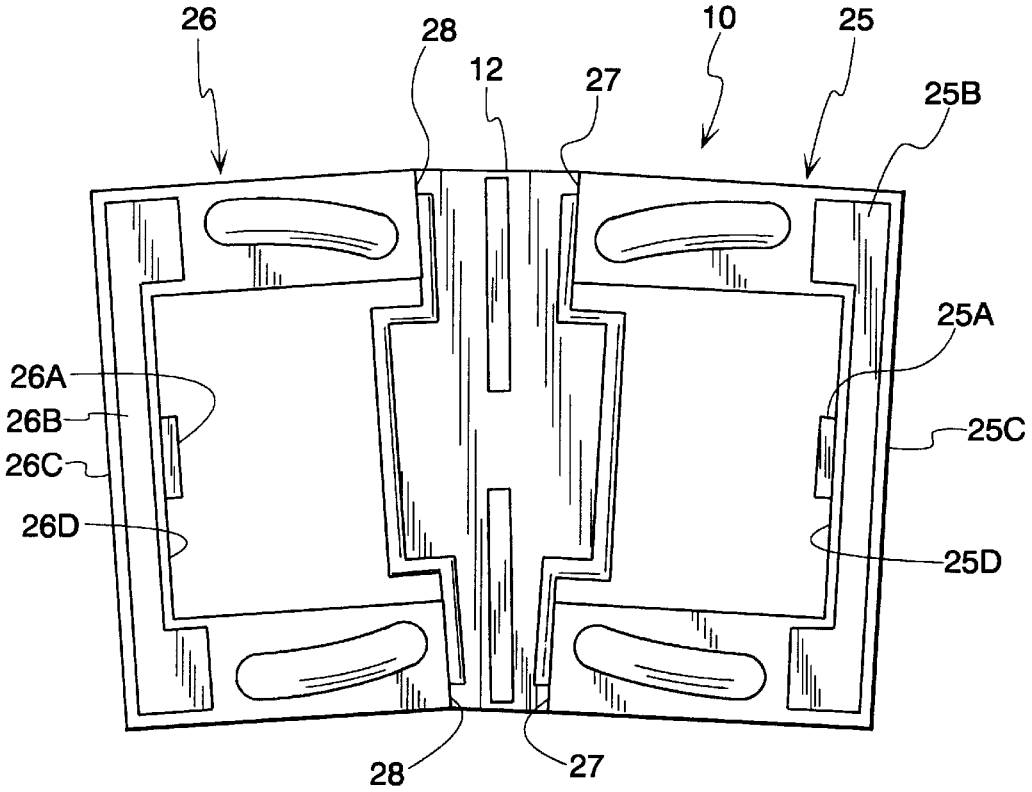
FIG. 2 is a top view of the foldable plastic slider in FIG. 1.

Referring to FIG. 1, the foldable plastic slider structure comprises an inverted U-shaped member including a transverse support member or body 12 from which a separating finger 11 depends. The body 8 also includes two integral depending legs 31, 32 and two hinged "wings" 25, 26. The lower ends of legs 31, 32 are provided with respective engaging shoulders 31*a*, 32*a* and respective angled surfaces 31*b*, 32*b* adjacent to the respective engaging shoulders 31*a*, 32*a*. The wings 25, 26 have respective cross pieces 25*c*, 26*c* forming respective solid sloped/ramp latches 25*a*, 26*a*, and respective cored out regions 25*b*, 26*b*. The wings 25, 26 also have respective wing shoulders 29,30. Referring to FIG. 2, the wings 25, 26 are connected to the body 12 by means of respective hinge structures 27, 28 located on opposite sides of the body 12. The hinge structures 27, 28 are relatively thin sections of plastic material as compared to the wall thicknesses of the wings 25, 26 and the flexibility of the plastic material makes possible the use of the integral hinge structures 27, 28 which are sometimes referred to as "living" hinges. The wings 25, 26 form central openings to receive the respective legs 31, 32 when the wings 25, 26 are folded down to the closed sidewall position, to be described later.

FIG. 3 depicts the slider 10 undergoing the process of assembly. The slider 10 is mounted on the tracks 14, 16 of the zipper 6 in such a way that the depending separating finger 11 is between the male and female profiles 18, 20 of the respective tracks 14, 16. The depending legs 31, 32 are positioned on the outside of the tracks 14, 16 in such a way that the tracks 14, 16 of the zipper 6 separate the depending separating finger 11 from the respective depending legs 31, 32. The wings 25, 26 are then rotated downward toward the bottom of the bag with the "living" hinges acting as the axis of rotation. FIG. 4 shows the slider in an assembled condition, the wings 25, 26 have been folded down to their closed sidewall state. The body 12 is adapted to move along the top edges of the zipper tracks 14, 16. The wings 25, 26 having wing shoulders 29, 30 that are positioned beneath the tracks 14, 16 to prevent the slider 10 from being lifted off the top of the zipper 6.

Figure 5:
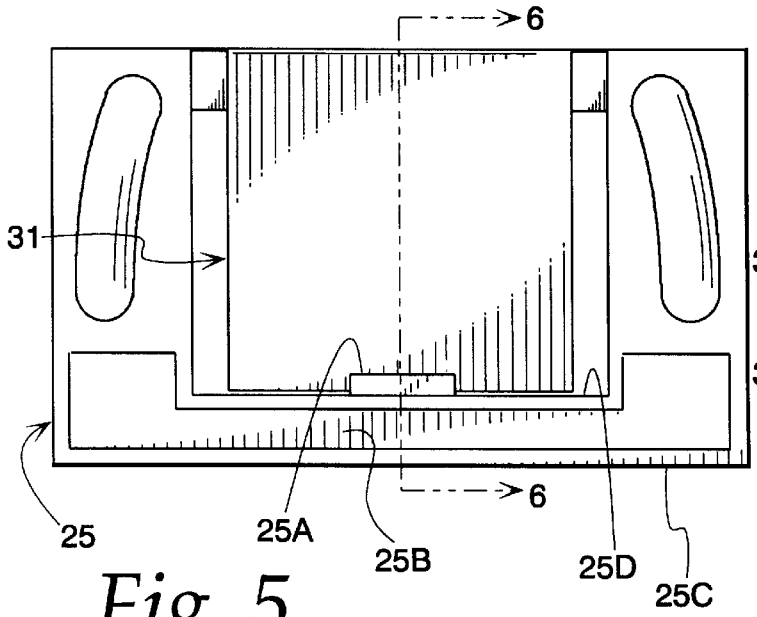
FIG. 5 is a side view of the foldable plastic slider just prior to latching the slider wings.
Figure 6:
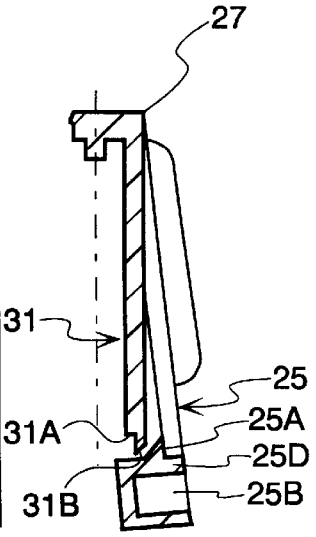
FIG. 6 is a sectional view taken generally along the lines 6—6 in FIG. 5.
Figure 7:
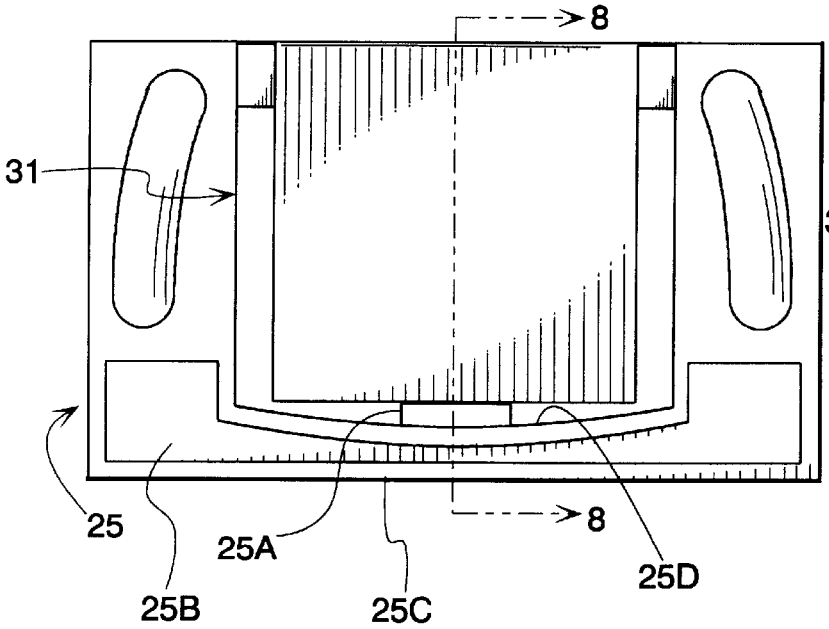
FIG. 7 is a side view of the foldable plastic slider in the process of latching the slider wings.
Figure 8:
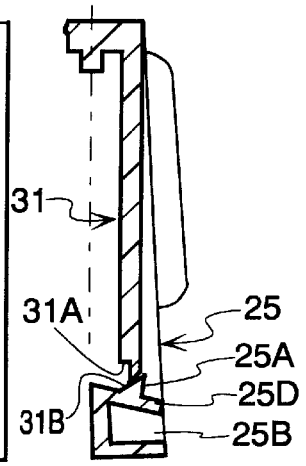
FIG. 8 is a sectional view taken generally along the lines 8—8 in FIG. 7.
Figure 9:
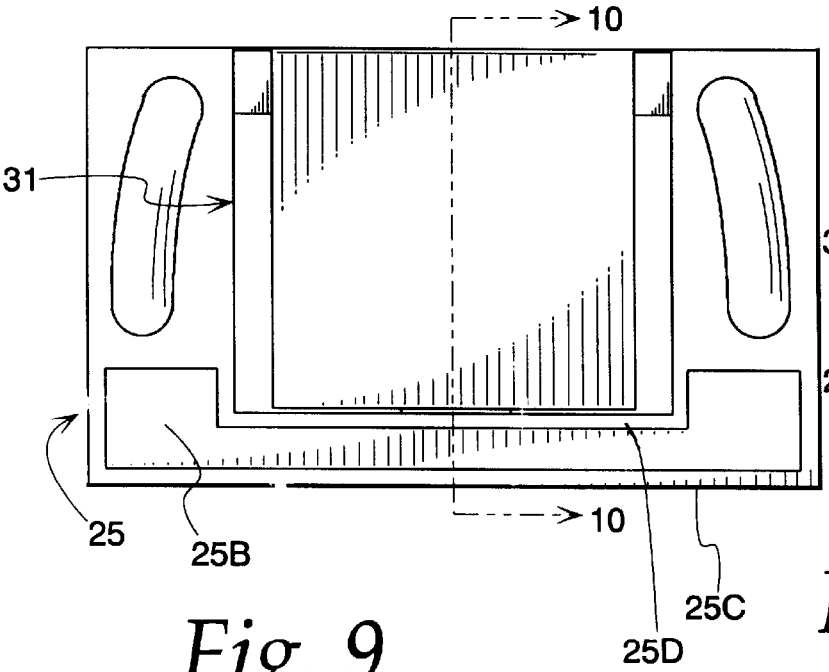
FIG. 9 is a side view of the foldable plastic slider after the slider wings have been latched in a closed sidewall position.
Figure 10:
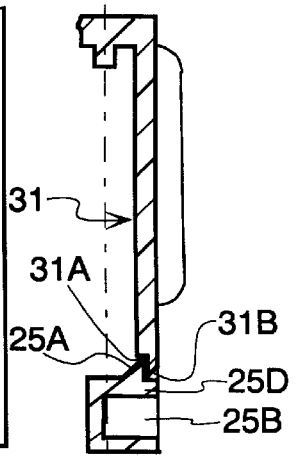
FIG. 10 is a sectional view taken generally along the lines 10—10 of FIG. 9.

When the wings 25, 26 are folded down from their open position to their closed sidewall position, the wings 25, 26 are held in place by an improved compression-type latch. As shown in FIGS. 5 and 6, when the wing 25 is rotated to the closed sidewall position the solid latch 25*a* will come into contact with the angled surface 31*b* adjacent to the latching shoulder 31*a*. When the wing 25 is moved toward the closed sidewall position the angled surface 31*b* exerts a force on the solid sloped latch 25*a* shown in FIGS. 7 and 8. The angles of the sloped latch 25*a* and the angled surface 31*b* cause the vector of the force to be in the downward direction. This causes the upper edge 25*d* of cored out region 25*b* to flex or depress. The cored out region 25*b* allows the upper edge 25*d* of the cross piece 25*c* to be a thinner piece of plastic. This allows the upper edge 25*d* to have the flexibility necessary to deflect down when the solid latch 25*a* comes into contact with leg 31. The upper edge 25*d* remains depressed until the leg 31 has completely passed over the solid sloped latch 25*a*. Then, the upper edge 25*d* returns to its original shape forcing the solid sloped latch 25*a* into engagement with shoulder 31*a* shown in FIGS. 9 and 10, thereby locking the wing 25 and leg 31 into the closed sidewall position.

The improved compression-type latch offers many advantages. It allows for easier installation of the slider 10 and increases the difficulty in removing the slider from the bag. The cored out region 25*c*, when depressed, acts similar to a spring in compression and once released forces the solid sloped latch 25*a* upward into a locked condition with the shoulder 31*a* of leg 31. As the wing 25 is being latched the angles of the solid sloped latch 25*a* and the angled surface 31*b* are able to work together to depress the upper edge 25*d*. However, when attempting to disengage the wing 25 from the leg 31 the direction in which the force acts is unable to depress the upper edge 25*d*; rather, it forces the leg 31 more strongly into engagement with the wing 25. This increases the difficulty in disassembling the slider. The old compression-type latch design using a flexible tongue latch without a cored out region as described more fully in U.S. Pat. No. 5,448,808 required an opening force to unlatch the wing from the leg ranging from 3.7 lbs., std. dev. 0.10 to 5.7 lbs., std. dev. 0.19. While this is impressive, the improved compression-type latch comprising a solid sloped latch and cored out region requires an opening force ranging from 8.3 lbs., std. dev. 0.26 to 9.9 lbs., std. dev. 0.17. This opening force greatly inhibits a user from removing the slider from the zipper.

It is to be understood that the other wing 26 has a solid sloped latch 26*a*, a s cored out region 26*b*, a cross piece 26*c*, and an upper edge 26*d* shown in FIG. 2, which allow the solid sloped latch 26*a* to engage the shoulder 32*a* of the leg 32. This provides a compression-type latch to lock wing 26 in place with leg 32. All of which functions in the same manner as for the wing 25 as described above.

Figure 13:
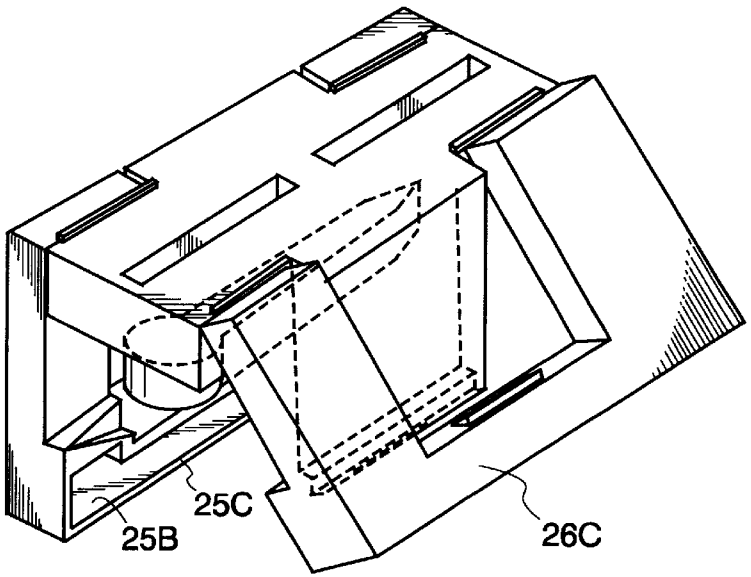
FIG. 13 is a perspective view of the foldable plastic slider in FIG. 11.
Figure 11:
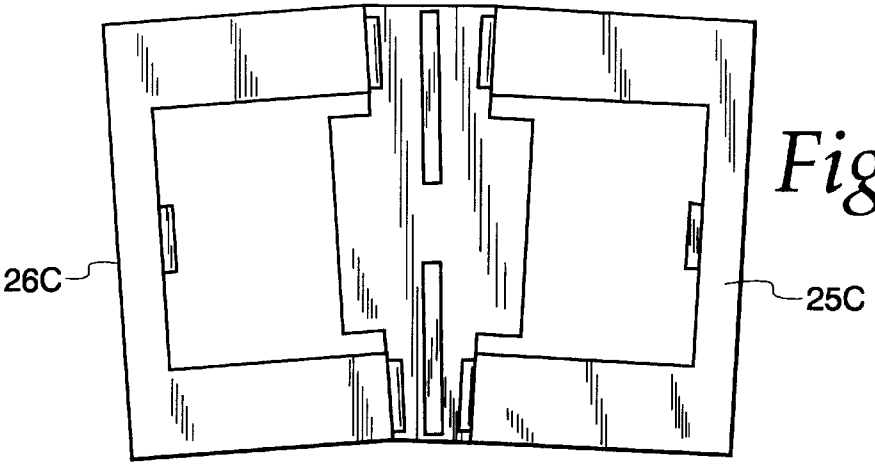
FIG. 11 is a top view of a foldable plastic slider in accordance with an alternative embodiment of the present invention.
Figure 12:
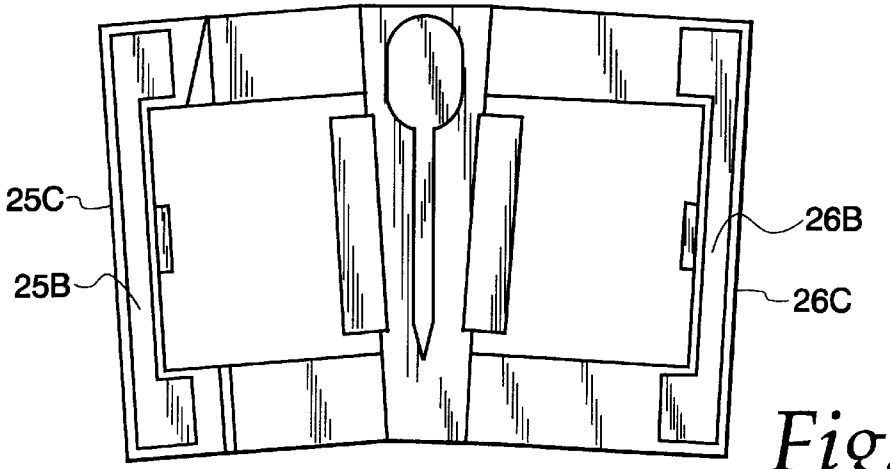
FIG. 12 is a bottom view of the foldable plastic slider in FIG. 11.

As shown in FIG. 4, the cored out regions 25*b*, 26*b* are on the exterior of the respective cross pieces 25*c*, 26*c*, face away from the respective bag panels 4, 5, and can be seen when the slider 10 is fully installed on the zipper 6. In an alternative embodiment depicted in FIGS. 11–13, where like reference numerals are used to designated analogous parts, the cored out regions 25*b*, 26*b* are on the interior of the respective cross pieces 25*c*, 26*c* and would face toward the bag panels and be hidden is from view when the slider is fully installed on a zipper. The compression-type latch on the slider in FIGS. 11–13 functions in substantially the same way as the compression-type latch on the slider in FIGS. 1–10.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A foldable plastic slider for straddling relation with a profiled plastic zipper, the straddling slider for closing or opening the zipper by movement therealong, said slider comprising:

a transverse support member including first and second opposing sides;

first and second legs depending from said respective first and second opposing sides of said support member; and first and second wings hingedly attached to said respective first and second opposing sides, said first and second wings having respective first and second openings for receiving said respective first and second legs, said first and second wings having respective first and second cross pieces, each of said cross pieces including a cored out main body member and a solid latch, said latch protruding surface of said main body member, said main body member defining a cavity disclosed below said surface, said first and second wings being folded relative to said support member and said latch engaging said respective leg to install said slider on said zipper.

2. The slider of claim 1, wherein said latch is generally centered on said respective main body member.

3. The slider of claim 1, wherein said cored oat main body member has a length, said cavity extending along said length.

4. The slider of claim 3, wherein said cavity has a generally rectangular shape.

5. The slider of claim 3, wherein said cavity is disposed on an exterior of said respective main body member and is visible when said slider is installed on said zipper.

6. The slider of claim 3, wherein said cavil is disposed on an interior of said respective main body member and is hidden from view when said slider is installed on said zipper.

7. The slider of claim 1, wherein said cored out main body member allows said respective latch to be depressed as said respective latch engages said respective leg.

8. The slider of claim 1, wherein each of said legs has an edge, said edge having a shoulder for engaging said respective latch.

9. In a reclosable plastic bag including a reclosable zipper, extending along a mouth of said bag, said zipper including a first track with a first profile and a second track with a second profile, said first and second profiles being releasably engageable to each other, a plastic slider slidably mounted to said zipper, said slider comprising:

a transverse support member having first and second opposing sides and a depending separating finger for engaging and disengaging said first and second profiles;

first and second legs depending from said respective first and second opposing sides; and first and second wings hingedly attached to said respective first and second opposing sides, said first and second wings having respective first and second openings for receiving said respective first said second legs, said first and second wings having respective first and second cross pieces, each of said cross pieces including a cored out main body member and a solid sloped latch, said latch protruding from a surface of said main body member, said main body member defining a cavity disposed below said surface, said solid sloped latch being adapted to engage said respective leg to install said slider on said zipper in an installed position.

10. The slider of claim 9, wherein said main body member has a length, said cavity extending along said length.

11. The slider of claim 10, wherein said cavity has a rectangular shape.

12. The slider of claim 10, wherein said cavity disposed on an exterior of said respective main body member and is visible when said slider is installed on said zipper.

13. The slider of claim 10, wherein said cavity is disposed on an interior of said respective main body member and is hidden from view when said slider is installed on said zipper.

14. The slider of claim 9, wherein said latch is generally centered on said respective main body member.

15. The slider of claim 9, wherein said cored out main body member allows said respective latch to deflect downward away from said respective leg while said respective latch engages said respective leg.

16. The slider of claim 9, wherein said first and second depending legs are generally perpendicular to said transverse support member.

17. A method of installing a foldable plastic slider on to a reclosable plastic bag including a reclosable zipper extending along a mouth of said bag, said zipper including a first track with a first profile and a second track with a second profile, said first and second profiles being releasably engageable to each other, said plastic slider being slidably mounted to said zipper, said method comprising the steps of:

supplying said slider with a transverse support member, first and second legs, and first and second wings, said support member having first and second opposing sides and a depending separating finger, said first and second legs depending fronm said respective first and second opposing sides, said first and second legs having respective first and second shoulders, said first and second wings hingedly attached to said respective first and, second opposing sides, said first and second wings having respective first and second cross pieces, each of said cross pieces including a cored out main body member and a solid sloped latch, said latch protruding from a surface of said main body member, said main body member defining a cavity disposed below said surface;

placing said transverse support member on said plastic zipper with said depending separating finger between said first and second tracks and said first and second depending legs outside said respective first and second tracks such that said respective first and second tracks separate said finger from said respective first and second legs;

rotating said first and second wings downward toward a bottom of said reclosable bag until said latch engages said respective leg, said cored out main body member allowing said respective latch to be deflected downward while said latch engage said respective leg; and pressing said first and second wings until said latch snaps into engagement with said respective shoulder of said respective leg.

18. The method of claim 17, wherein said cavity defined by said respective main body member allows said respective latch to depress away from said respective leg during said step of rotating said first and second wings.

19. The method of claim 18, wherein said cored out main body member forces said respective latch upward in such a way that said latch is in a locked condition with said respective shoulder of said respective leg during said step of pressing said first and second wings.

20. The method of claim 19, wherein after said step of pressing said first and second wings, said first and second legs and said respective first and second wings are in a locked, assembled condition.

* * * * *

UNITED STATES PATENT AND TRADEMARK OFFICE

CERTIFICATE OF CORRECTION

PATENT NO. : 5,867,875

DATED : February 9, 1999

INVENTOR(S) : Roland G. Beck et al

It is certified that error appears in the above-identified patent and that said Letters Patent is hereby corrected as shown below:

| | |
|---|---|
| Column 5, Claim 1, line 9 | replace "disclosed" with --disposed--. |
| Column 5, Claim 6, line 24 | replace "cavil" with --cavity--. |
| Column 5, Claim 9, line 49 | replace "first said second" with --first and second--. |
| Column 5, Claim 12, line 62 | insert --is-- after "cavity" and before "disposed". |
| Column 6 Claim 17, line 23 | replace "fronm" with --from--. |
| Column 6, Claim 17, line 27 | delete "," between "and" and " second". |
| Column 6, Claim 17, line 46 | replace "engage" with --engages--. |

Signed and Sealed this

Ninth Day of January, 2001

*Attest:*

Q. TODD DICKINSON

*Attesting Officer*

*Commissioner of Patents and Trademarks*